US006260778B1

(12) United States Patent
Wenger

(10) Patent No.: US 6,260,778 B1
(45) Date of Patent: Jul. 17, 2001

(54) TUB GRINDER WITH ADJUSTABLE SWING DIAMETER HAMMER MILL

(75) Inventor: Timothy G. Wenger, Sabetha, KS (US)

(73) Assignee: C. W. Mill Equipment Co., Inc., Sabetha, KS (US)

( * ) Notice: Subject to any disclaimer, the term of this patent is extended or adjusted under 35 U.S.C. 154(b) by 0 days.

(21) Appl. No.: 09/339,433

(22) Filed: Jun. 24, 1999

(51) Int. Cl.[7] ..... B02C 13/284
(52) U.S. Cl. ..... 241/73; 241/101.761; 241/186.4
(58) Field of Search ..... 241/192, 186.4, 241/101.761, 73, 189.1

(56) References Cited

U.S. PATENT DOCUMENTS

| | | | |
|---|---|---|---|
| 4,106,706 | 8/1978 | Burrows . | |
| 4,773,601 | 9/1988 | Urich . | |
| 5,419,502 | 5/1995 | Morey . | |
| 5,570,849 | 11/1996 | Anderson . | |
| 5,626,298 | 5/1997 | Arnoldy . | |
| 5,887,808 * | 3/1999 | Lucas | 241/192 |

FOREIGN PATENT DOCUMENTS

| | | | |
|---|---|---|---|
| 688523 * | 3/1953 | (GB) | 241/192 |

* cited by examiner

*Primary Examiner*—Mark Rosenbaum
(74) *Attorney, Agent, or Firm*—Shughart Thomson & Kilroy P.C.

(57) ABSTRACT

An improved tub grinder includes a hammer mill having a swing diameter which is adjustable. The tub grinder includes: first and second sets of interchangeable hammers, the second set being shorter than the first; first and second interchangeable semi-cylindrical screen assemblies, the second screen assembly having a smaller diameter than the first; and a pair of shear bars and adapter plates. In a first configuration, the first set of hammers are mounted to a rotor assembly and have a first swing diameter. The first semi-cylindrical screen assembly is secured within a cylinder box in co-axial alignment and outwardly spaced relationship with the first set of hammers. The shear bars are mounted to the tub floor and extend across the sides of a floor opening in spaced relationship to the swing diameter of the first set of hammers to form a gap therebetween. In a second configuration, the first set of hammers are replaced by the second set of hammers which are mounted to the rotor assembly and have a second, smaller, swing diameter. The first semi-cylindrical screen assembly is removed and replaced by the second screen assembly and the shear bars are mounted on adapter plates to move leading edges thereof closer to the rotational path of the second set of hammers.

6 Claims, 4 Drawing Sheets

Fig.1.
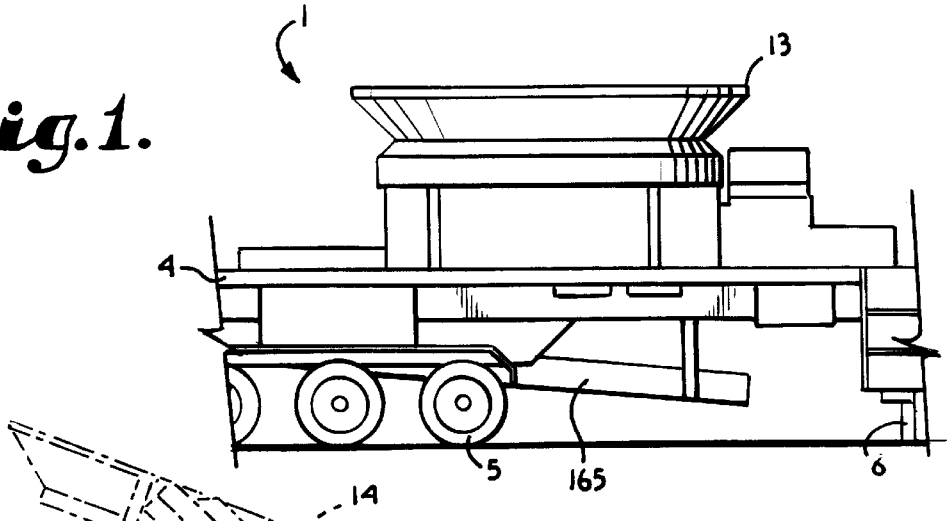
Fig.4.
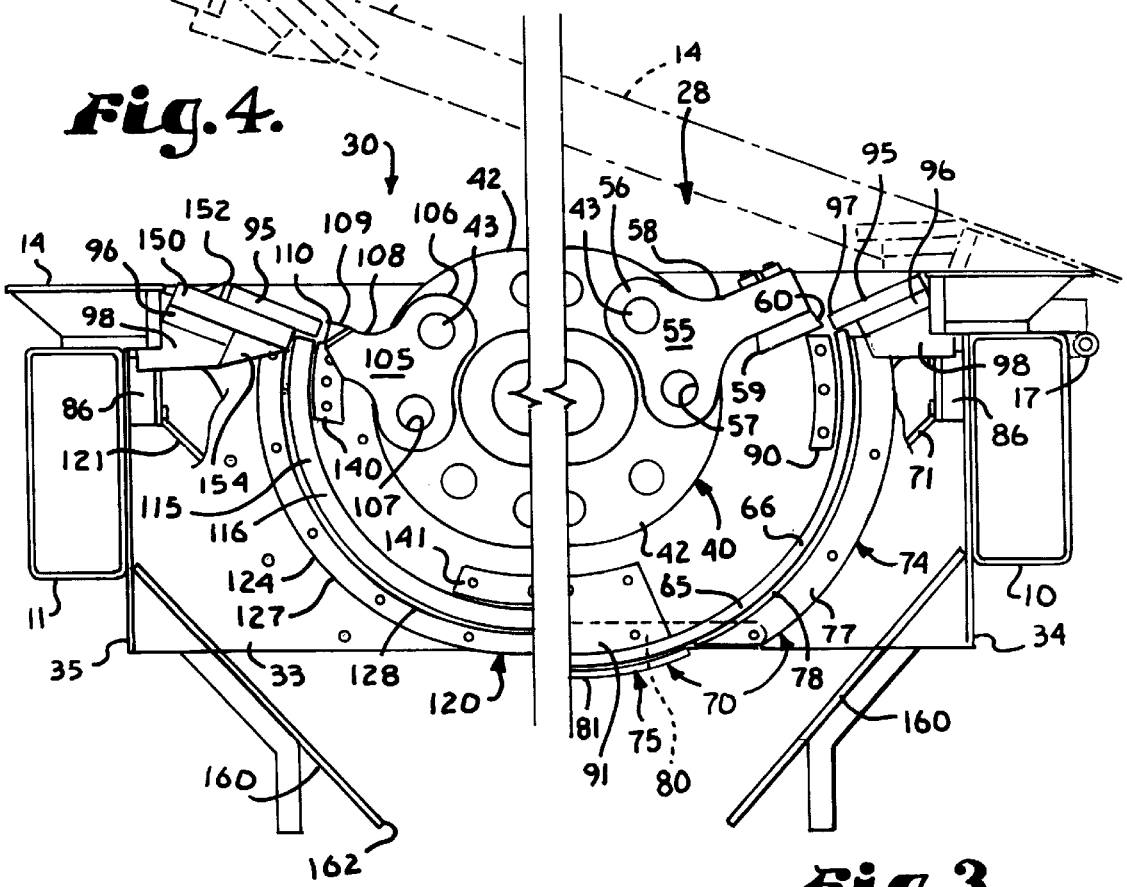
Fig.3.

TUB GRINDER WITH ADJUSTABLE SWING DIAMETER HAMMER MILL

BACKGROUND OF THE INVENTION

The present invention relates to tub grinders and in particular a tub grinder in which the swing diameter of the hammer mill incorporated therein is adjustable.

Tub grinders are used for chopping or grinding various materials to facilitate handling, disposal or processing. Tub grinders generally comprise a stationary floor with a cylindrical side wall which rotates relative to the floor. Projections or fins extending inwardly from the sidewall engage material positioned in the tub causing the material to rotate with the cylindrical side wall relative to the floor. A hammer mill having a plurality of hammers extending radially outward is rotatably mounted below the floor of the tub grinder such that the hammers extend above the floor and into contact with the material to be ground during a portion of the hammers path of rotation.

Traditionally, tub grinders have been equipped with a hammer mill having a fixed swing diameter. However, variations in the properties of the material to be ground can significantly affect the efficiency of the tub grinder. Therefore, existing tub grinders are limited in the type or size of materials they can process efficiently. For example, for some materials, the depth of cut provided by the hammer mill will be too deep causing the machine to bog down. For other materials, the same hammer mill will take in less material than it is capable of efficiently processing, adding time and cost to the grinding process.

Due to the costs of tub grinders, it is generally impractical for the operator to purchase different tub grinders for processing different materials. The operators generally must base their purchasing decision on the efficiency of the particular hammer mill (based in part on its hammer mill swing diameter) in processing the material most commonly processed by that operator. There remains a need for tub grinders which provide greater flexibility in efficiently processing different materials.

SUMMARY OF THE INVENTION

The present invention comprises a tub grinder having a hammer mill having a swing diameter which is adjustable. The tub grinder includes: a first and second set of interchangeable hammers, the second set being shorter than the first; first and second interchangeable semi-cylindrical screen assemblies, the second screen assembly having a smaller diameter than the first; and a pair of shear bars and adapter plates.

In a first configuration, the first set of hammers are mounted to a rotor assembly and have a first swing diameter. The first semi-cylindrical screen assembly, having a radius of curvature slightly greater than the radius of the first set of hammers, is secured within a cylinder box or hammer mill housing in co-axial alignment and outwardly spaced relationship with the first set of hammers. The first screen assembly is supported on screen tracks mounted on opposite ends of the hammer mill housing and are held thereagainst by inside screen retainers which are also mounted to the opposite ends of the hammer mill housing.

The shear bars are mounted to shear bar mounts on the floor of the tub grinder on opposite sides of the hammer mill housing. The shear bar mounts are angled downward and inward toward the axis or rotation of the rotor assembly, such that the shear bars are similarly angled toward the axis of rotation of the rotor assembly. A small gap extends between the outer rotational path or swing diameter of the first set of hammers and the shear bars and the first screen assembly to produce a shearing or chopping action between the hammers and the shear bar and a grinding action between the hammers and the first screen assembly which has a plurality of openings extending therethrough.

In a second configuration, the first set of hammers are replaced by the second set of hammers which are mounted to the rotor assembly and have a second swing diameter which is smaller than the first swing diameter. The first semi-cylindrical screen assembly is removed and replaced by the second screen assembly which has a smaller radius of curvature. The screen tracks and screen retainers used to support the first semi-cylindrical screen assembly are replaced by a second set thereof adapted to support the second screen assembly relative to the cylinder box.

An adapter bar is mounted to each of the shear bar mounts and a shear bar is mounted to each adapter bar to move a leading edge of each shear bar closer to the path of rotation of the hammers. Each adapter bar positions a leading edge of an attached shear bar approximately the same distance away from the second set of hammers as the shear bars are positioned away from the rotational path of the first set of hammers when mounted directly to the shear bar mounts in the first configuration. Similarly, the distance between the rotational path of the second set of hammers and the second screen assembly is approximately the same as the distance between the rotational path of the first set of hammers and the first screen assembly.

OBJECTS AND ADVANTAGES OF THE INVENTION

It is an object of this invention to provide a tub grinder in which the rotational path of a hammer mill assembly associated therewith is adjustable; to provide such a tub grinder which incorporates a first and second set of interchangeable hammers, one set being longer than the other, which are selectively and interchangeably securable to a hammer mill rotor assembly of the tub grinder; to provide such a tub grinder having first and second semi-cylindrical screen assemblies which are selectively and interchangeably securable to a hammer mill housing of the hammer mill to selectively accommodate the swing diameter of the first and second set of hammers respectively; to provide such a hammer mill in which the shear bars may be moved closer or further away from an axis of rotation of the rotor assembly to accommodate the swing diameter of the first and second set of hammers respectively; to provide such a tub grinder in which it is relatively easy to modify the swing diameter of the hammers; to provide such a tub grinder in which it is relatively easy to interchange the first screen assembly with the second screen assembly; and to provide such a tub grinder which is particularly well adapted for its intended uses thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a fragmentary side elevational view of a tub grinder of the present invention.

FIG. 3 is an enlarged and fragmentary cross-sectional view taken generally along line 3—3 of FIG. 2 showing a first hammer mill assembly having a first swing diameter mounted within a hammer mill housing;

FIG. 4 is a view similar to FIG. 3 showing a second hammer mill assembly having a second, smaller swing diameter, mounted within the hammer mill housing;

DETAILED DESCRIPTION OF THE INVENTION

Figure 2:
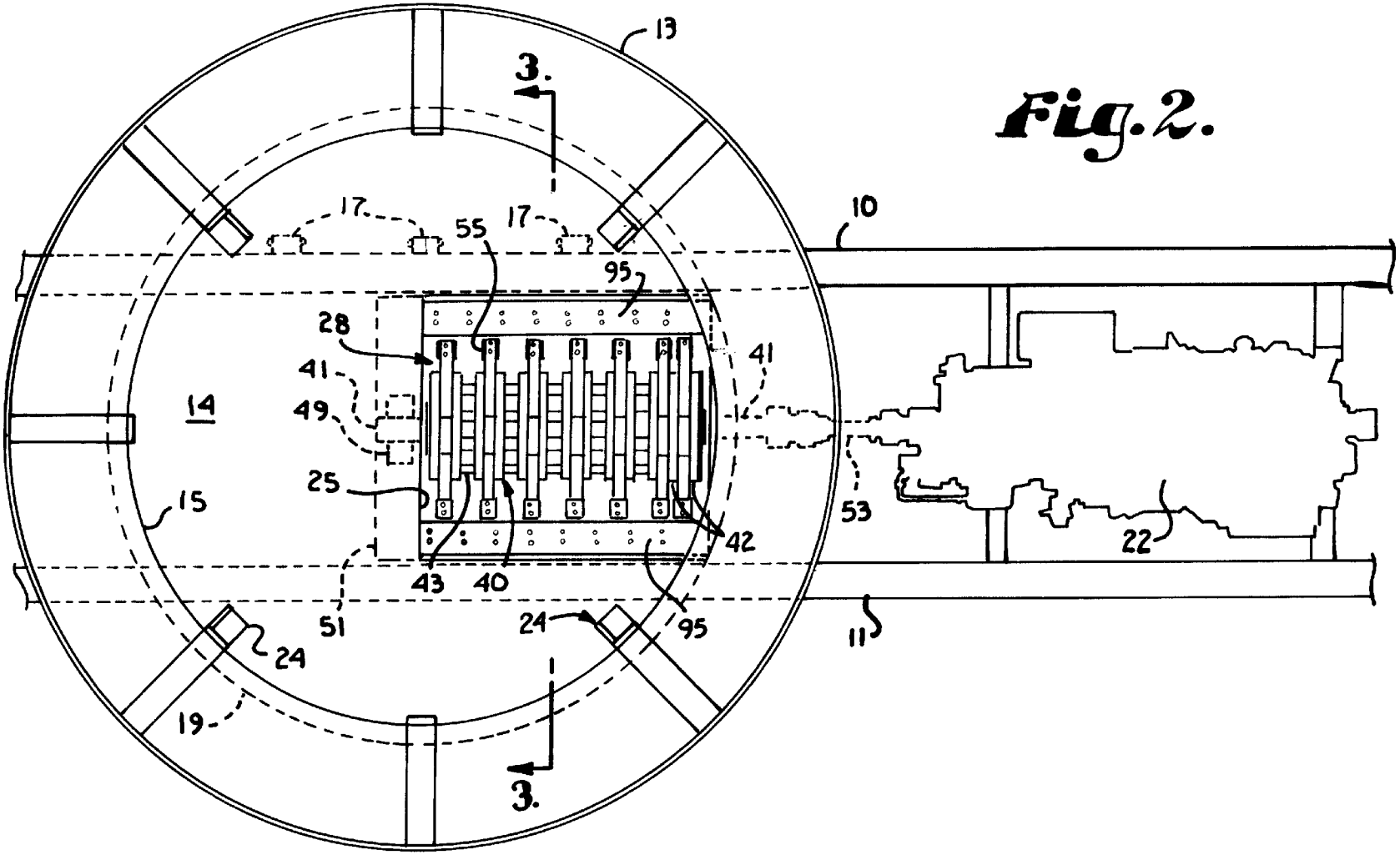
FIG. 2 is an enlarged and fragmentary, partially schematic, top plan view of the tub grinder.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 refers to a tub grinder of the present invention which is adapted to process materials such as limbs, pallets, organic material and the like. The tub grinder 1, only a portion of which is shown in FIG. 1, includes a frame 4 mounted on wheels 5 to form a trailer. Jacks 6 support the front end of the tub grinder when not connected to a towing vehicle.

Referring to FIG. 2 the frame 4 comprises first and second beams or frame members 10 and 11 formed from square tubing. A tub 13, adapted to receive material to be processed and comprising a circular tub floor 14 and a cylindrical tub sidewall 15, is supported on the frame members 10 and 11. The tub floor 14 is pivotally mounted to frame member 10 by hinges 17 such that the tub 13 may be tilted off of the frame members 10 and 11 by a hydraulic actuator (not shown) over 100° relative thereto. The tub sidewall 15 is rotatably mounted to the tub floor 14 and rotates thereabout. The tub sidewall 15 flares slightly outward at the lower end thereof above floor 14 as represented by the phantom line 19 in FIG. 2. The tub sidewall 15 is rotatably mounted to the floor 2 and rotated by conventional drive means, not shown, such as a chain drive system utilizing a hydraulic motor connected to and powered by engine 22 which is mounted to the frame members 10 and 11.

Four fins 24 are mounted to an inner surface of the tub sidewall 15 and extend inward therefrom at a slight angle relative to a vertical orientation. The fins 24 are adapted to engage material positioned in the tub 13 causing the material to rotate about the floor 14 which remains stationary as the tub sidewall 15 rotates.

A rectangular opening 25 referred to as a floor opening or hammer mill opening is formed in and extends through the tub floor 14. The floor opening 25 generally extends lengthwise between the frame members 10 and 11 and radially from approximately the center of the tub floor 14 toward the tub sidewall 15.

Referring to FIGS. 3 and 4, FIG. 3 shows a first hammer mill assembly 28 mounted below the tub floor 14 and the floor opening 25 within a hammer mill housing or cylinder box 29 which is mounted to the frame members 10 and 11 below the floor 14 and the floor opening 25. FIG. 4 shows a second hammer mill assembly 30 mounted within the hammer mill housing 29. The hammer mill housing or cylinder box 29 comprises first and second end walls 32 and 33 and first and second sidewalls 34 and 35. The first and second sidewalls 34 and 35 are welded to the frame members 10 and 11 respectively and the first and second end walls 32 and 33 are welded to and extend between the first and second sidewalls 34 and 35. The outer periphery of the hammer mill housing 29 is slightly wider than the outer periphery of the floor opening 25.

The hammer mill rotor assembly 40 is rotatably mounted within the hammer mill housing 29. The rotor assembly 40 includes a rotor shaft 41, rotor plates 42 and mounting pins 43. The rotor shaft 41 extends through upwardly opening slots 45 (see FIGS. 5 and 6) in each end wall 32 and 33 and is supported on shaft bearings 48 and 49 mounted on bearing mounts 50 and 51 welded to the end walls 32 and 33 respectively on the outer surfaces thereof. The rotor shaft 41 is coupled to an engine shaft 53 of engine 22 which rotates the rotor shaft 41 about an axis of rotation or rotor axis.

The rotor plates 42 are annular and are secured to the rotor shaft 41 in spaced apart relation and extend radially outward therefrom. In a preferred embodiment, thirteen rotor plates 42 are secured to the rotor shaft 41. Eight mounting pins 43 extend through aligned apertures 54 in each of the rotor plates 42 and are removably secured in place by conventional means, such as a locking plates or retainers (not shown) which may be pivoted into and out of covering relationship with the apertures in the rotor plate 42 furthest from the engine 22.

The first hammer mill assembly 28 includes a set of first hammers 55 which are removably securable to the rotor plates 42 using mounting pins 43. Each first hammer 55 includes a base 56 with a pair of apertures 57 and a stem 58 extending outward therefrom. A head 59 formed from hardened steel is bolted to the hammer stem 58 on one side thereof. The first hammers 55 are removably secured to the rotor plates 42 by removing the mounting pins 43, positioning the base 56 of each first hammer 55 between adjacent rotor plates 42 with the pair of apertures 57 of each base 56 aligned with a pair of apertures 54 in the rotor plates 42. The mounting pins 43 are then inserted through the aligned apertures 54 and 57 in the rotor plates 42 and the bases 56 of the first hammers 55 and the mounting pins 43 are secured in place by conventional means as discussed above. In the embodiment shown in FIG. 2, two first hammers 55 are secured between each rotor plate 42.

When mounted to the rotor assembly 40, the first hammers 55 have a first radius, comprising the distance from the rotor axis to a tip 60 of each first hammer 55. In a preferred embodiment, the first radius is approximately 22.75 inches, such that the first hammer mill assembly 28, with the first hammers 55 secured thereto, has a swing diameter of approximately 45.5 inches. The swing diameter corresponds to the diameter of the circle formed by the path of rotation of the outer ends of the hammers.

Figure 5:
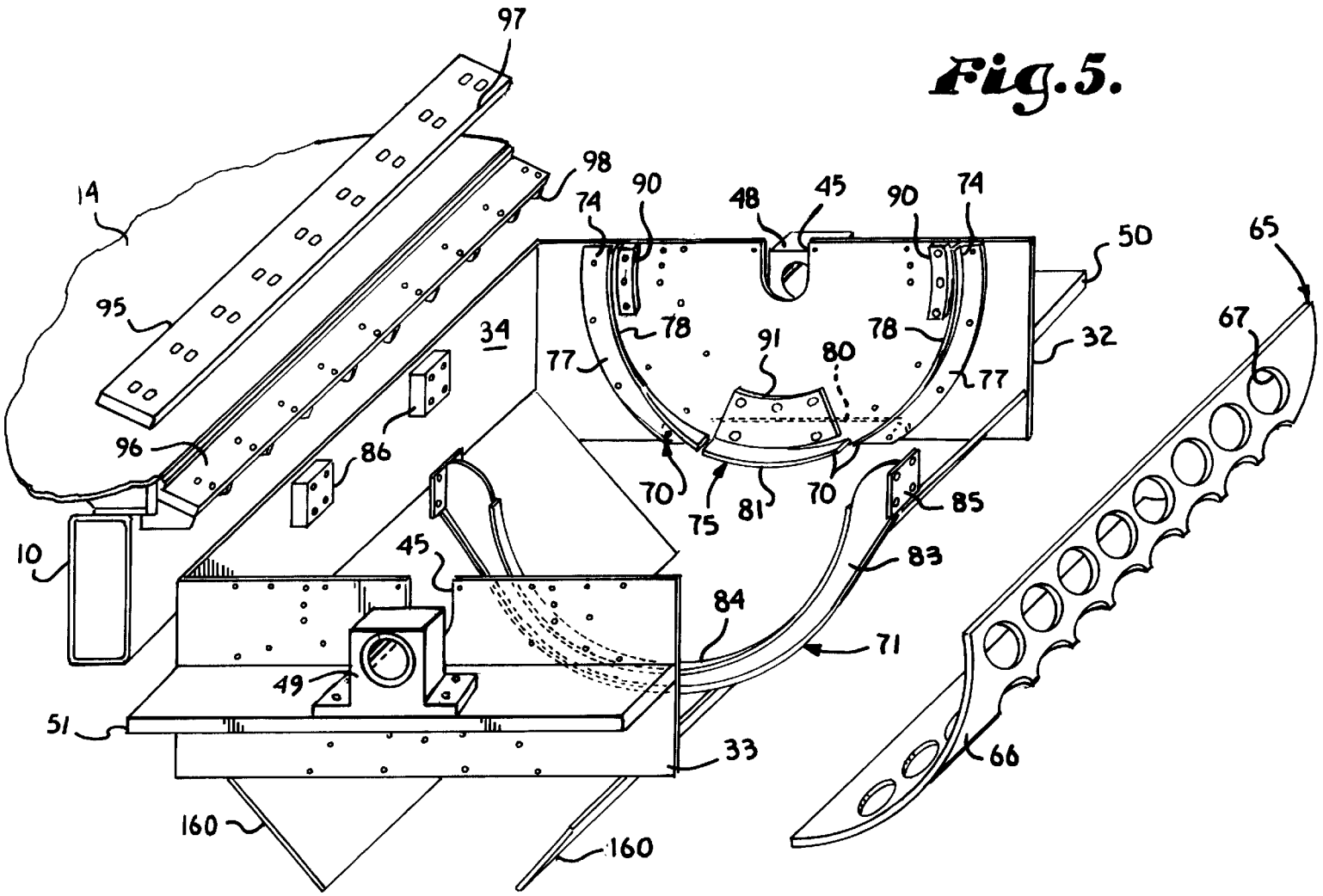
FIG. 5 is a fragmentary and exploded perspective view of the hammer mill housing with portions of the first hammer mill assembly shown secured thereto.

The first hammer mill assembly 28 also includes a first or large semi-cylindrical screen assembly 65 removably securable between the first and second end walls 32 and 33 of the hammer mill housing 29 in co-axial alignment with the rotor axis. The first screen assembly 65 comprises a pair of first screens or grates 66, one of which is shown in FIGS. 3 and 5. Each screen 66 has a plurality of openings 67 formed therein. Although the openings 67 are shown as round in FIG. 5 it is to be understood that a wide variety of shapes as well as sizes and spacing could be utilized for the openings 67. In a preferred embodiment, the arc formed by each screen 66 is slightly greater than 90°, such that the overall arc formed by the first screen assembly 65 is greater than 180°.

The radius of curvature of each screen 66 and the first screen assembly 65 is slightly greater than the first radius of the first hammers 55 mounted to the rotor assembly 40. The screens 66 are mounted between the end walls 32 and 33 in co-axial alignment with the axis or rotation of the rotor assembly such that a gap of approximately ½ inch extends between an inner surface of the screens 66 and the rotational path of the tip 60 of each first hammer 55. The screens 66 are mounted to the hammer mill housing 29 such that the first screen assembly 65 extends below the floor 14 and the floor opening 25.

The first screen assembly 65 is supported between the end walls 32 and 33 by first or large screen track assemblies 70 removably securable to each end wall 32 and 33 and a pair of first screen carriers 71, one of which is shown in FIG. 3. Each first screen track assembly 70 comprises two upper track sections 74 and a lower track section 75. The upper track sections 74 each include a mounting flange 77 with apertures extending therethrough which are spaced for alignment with an outer set of apertures formed in each end wall 32 and 33 in an arcuate path. The upper track sections are removably securable to the end walls 32 and 33 by securing bolts through the aligned sets of apertures in the mounting flanges 77 and the end walls 32 and 33. Each upper track section 74 also includes an arcuate support shoulder, lip or flange 78 extending inward from the end wall 32 and 33, when the track section 74 is secured thereto, to provide a surface for supporting the end of the screens 66. The support shoulders 78 of the upper track sections 74 are arcuate, having a radius of curvature approximately equal to the radius of curvature of an outer surface of the first screen assembly 65.

Each lower track section 75 includes a mounting bracket 80 adapted to be bolted to the end walls 32 and 33 on the outer surface and at a lower end thereof. An arcuate support shoulder 81 is welded to the bottom of the mounting bracket 80 and when the mounting bracket 80 is bolted to an end wall 32 or 33 the lower support shoulder extends beneath a lower end of the end wall 32 or 33 and toward the interior of the hammer mill housing 29 in alignment with the support shoulders 78 of the upper track sections 74. The arcuate support shoulder 81 of the lower track section 75 has a radius of curvature approximately the same as the outer surface of the first screen assembly 65.

Each of the first screen carriers 71 comprises a curved strap 83 having an arcuate support flange 84 formed on an inner, upper edge thereof and mounting flanges 85 secured on the ends thereof. The mounting flanges 85 are adapted to be bolted to mounting blocks 86 welded to the first and second sidewalls 34 and 35 of the hammer mill housing 29. The radius of curvature of the arcuate support flanges 84 is the same as the radius of curvature of the arcuate support shoulders 78 and 81 of the upper and lower track sections 74 and 75 respectively. The support shoulders 78 and 81 of upper and lower track sections 74 and 75 and the support flanges 84 of the screen carriers 71 are adapted to support the first screens 66 of the first screen assembly 65.

The first screen assembly 65 is secured against each of the first screen track assemblies 70 by a pair of first upper screen retainers 90 and a first lower screen retainer 91. The first upper and lower screen retainers 90 and 91 are generally arcuate with arcuate outer surfaces corresponding in curvature to the curvature of the inner surface of the first screens 66. The first upper screen retainers 90 have apertures formed therein spaced apart to correspond with apertures formed in the end walls 32 and 33 in a second or middle arcuate path. The first upper screen retainers 90 are bolted to inner surfaces of the end walls 32 and 33 in inwardly spaced relation to the support shoulders 78 of the upper track sections 74 at upper ends thereof to form an arcuate channel or slot extending therebetween which is slightly wider than the thickness of the first screens 66. The first lower screen retainers 91 have a plurality of apertures formed therein which are adapted for alignment with apertures in the end walls 32 and 33 such that the first lower screen retainers 91 may be bolted to the end walls 32 and 33. The first lower screen retainers 91 are secured to the end walls 32 and 33 in inwardly and upwardly spaced relation to the support shoulder 81 of the lower track section 75 to form an arcuate channel extending therebetween which is slightly wider than the thickness of the first screens 66. There is sufficient clearance between the upper screen retainers 90 and the support shoulders 78 of upper track sections 74 and the lower screen retainers 91 and the support shoulders 81 of the lower track sections 75 to permit the ends of the screens 66 to slide therebetween to facilitate insertion and removal of the screens 66. The first upper screen retainers 90 are positioned in front of upper or outer ends of the screens 66 and the first lower screen retainers 91 are positioned in front of lower or inner ends of the screens 66 to prevent the screens 66 from advancing into the path of the hammers 55.

The screens 66 are secured in place and prevented from rotating out from between the screen track assemblies 70 and retainers 90 and 91, during use, by shear bars 95 which are secured to the tub floor 14 along opposite sides of the floor opening 25. The shear bars 95 are bolted to mounting plates 96 which are welded to the tub floor 14 at a downwardly and inwardly sloping angle so as to be generally angled toward the rotor axis of rotation or rotor axis. The mounting plates 96 are angled such that the shear bars 95, when mounted to the mounting plates 96, generally extend in radial alignment with the rotor axis such that the path of the hammer tips 60 generally extends transverse to a leading edge 97 of the shear bars 95. The leading edges 97 of the shear bars 95 are spaced approximately an equal distance from the hammer tips 60 as the inner surface of the first screens 66, which in a preferred embodiment is approximately ½ inch. When mounted in place, a lower surface of each shear bar 95, across the front thereof, extends in closely spaced relation over an upper edge of an associated screen 66 to secure the screens 66 in place. Gussets 97, welded to the mounting plates 96 and the tub floor 14, provide support for the mounting plates 96.

As noted above, the tub 13, including the tub floor 14, may be pivoted off of the frame members 10 and 11 along hinges 17 to expose the hammer mill housing 29 and the first or second hammer mill assembly 28 or 30 mounted therein. Pivoting of the tub 13 relative to the frame members 10 and 11 is controlled by conventional means such as a hydraulic actuator, not shown. Pivoting the tub floor 14 away from the frame members 10 and 11, advances the shear bars 95 out of abutting relationship with the upper ends of first screens 66, to permit removal and replacement of the first screens 66 such as for replacing the first hammer mill assembly 28 with the second hammer mill assembly 30.

Referring to FIG. 4, the second hammer mill assembly 30 includes a set of second hammers 105 which are removably securable to the rotor plates 42 using the mounting pins 43 in the same manner as described above for the first hammers 55. Each second hammer 105 includes a base 106 with a pair of apertures 107 and a stem 108 extending outward therefrom. A head 109 formed from a triangular piece of hardened steel is welded to the hammer stem 108 on an outer end thereof.

When mounted to the rotor assembly 40, the second hammers 105 have a second radius, comprising the distance from the rotor axis to a tip 110 of each second hammer 105. In a preferred embodiment, the second radius is smaller than the first radius associated with the first hammers 55 and is approximately 18 inches. The second hammer mill assembly 30, with the second hammers 105 secured thereto, has a swing diameter of approximately 36 inches, which is smaller than the swing diameter of the first hammer mill assembly 28.

Figure 6:
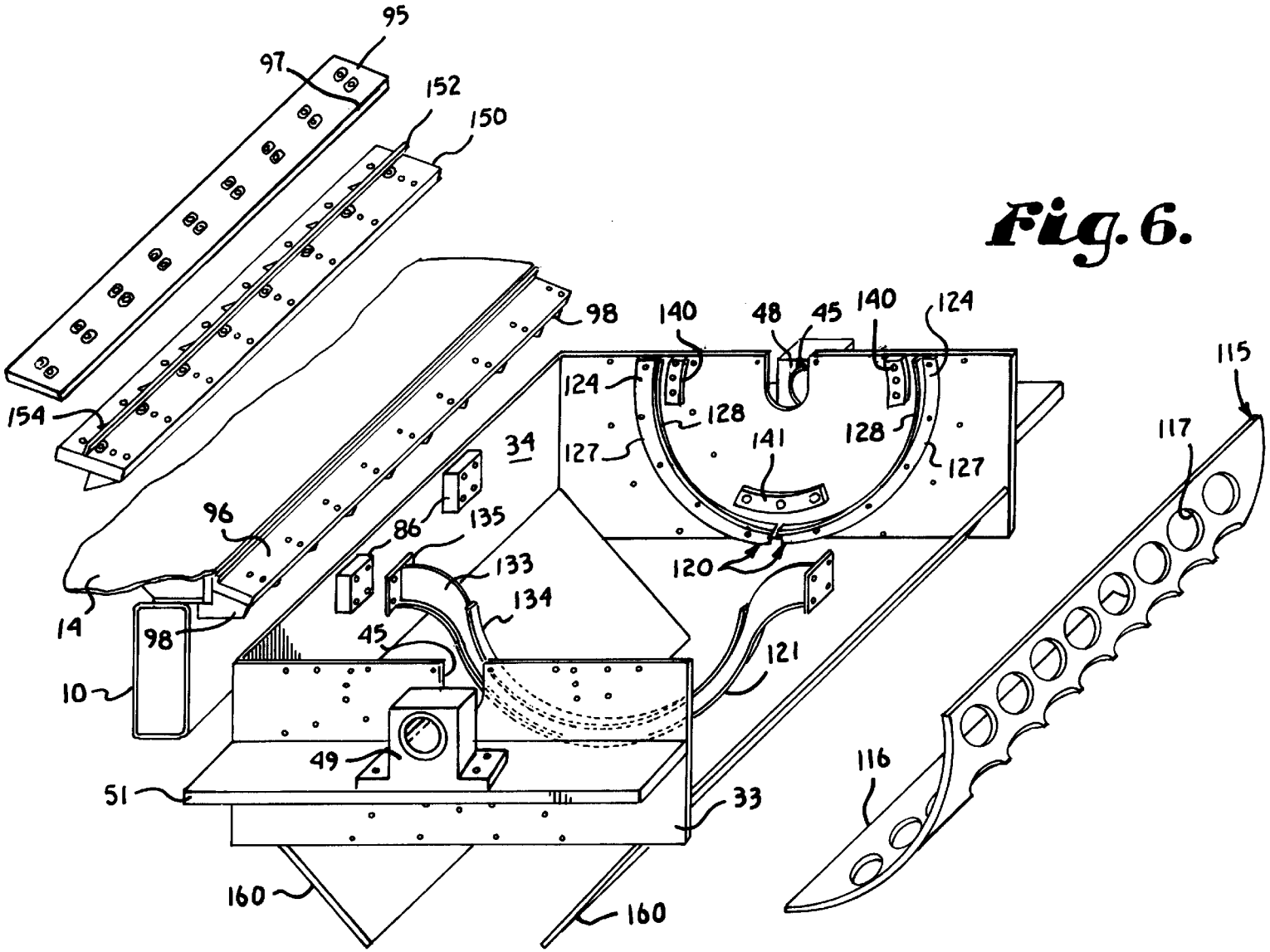
FIG. 6 is a fragmentary and exploded perspective view of the hammer mill housing with portions of the second hammer mill assembly shown secured thereto.

The second hammer mill assembly 30 also includes a second or small semi-cylindrical screen assembly 115 removably securable between the first and second end walls 32 and 33 of the hammer mill housing 29 in co-axial alignment with the rotor axis. The second screen assembly 115 comprises a pair of second screens or grates 116, one of which is shown in FIGS. 4 and 6. Each screen 116 has a plurality of openings 117 formed therein. Although the openings 117 are shown as round in FIG. 6 it is to be understood that a wide variety of shapes as well as sizes and spacing could be utilized for the openings 117. In a preferred embodiment, the arc formed by each screen 116 is slightly greater than 90°, such that the overall arc formed by the second screen assembly 115 is greater than 180°.

The radius of curvature of each screen 116 and the second screen assembly 115 is slightly greater than the second radius of the second hammers 105 mounted to the rotor assembly 40. The screens 116 are mounted between the end walls 32 and 33 such that a gap of approximately ½ inch extends between an inner surface of the screens 116 and the rotational path of the tip 110 of each second hammer 105. The screens 116 are mounted to the hammer mill housing 29 such that the first screen assembly 115 extends below the floor 14 and the floor opening 25.

The second screen assembly 115 is supported between the end walls 32 and 33 by second or small screen track assemblies 120 removably securable to each end wall 32 and 33 and a pair of second screen carriers 121, one of which is shown in FIG. 4. Each second screen track assembly 120 comprises two upper track sections 124. The upper track sections 124 each include a mounting flange 127 with apertures extending therethrough which are spaced for alignment with the middle set of apertures formed in each end wall 32 and 33 in an arcuate path. The upper track sections 124 are removably securable to the end walls 32 and 33 by securing bolts through the aligned sets of apertures in the mounting flanges 127 and the end walls 32 and 33. Each upper track section 124 also includes an arcuate support shoulder, lip or flange 128 extending inward from the end wall 32 and 33, when the track section 124 is secured thereto, to provide a surface for supporting the end of the screens 116. The support shoulders 128 of the upper track sections 124 are arcuate, having a radius of curvature approximately equal to the radius of curvature of an outer surface of the second screen assembly 115. Lower ends of the support shoulders 128 extend in closely spaced relation to one another and in radial alignment when mounted to one of the end walls 32 and 33.

Each of the second screen carriers 121 comprises a curved strap 133 having an arcuate support flange 134 formed on an inner, upper edge thereof and mounting flanges 135 secured on the ends thereof. The mounting flanges 135 are adapted to be bolted to the mounting blocks 86 welded to the first and second sidewalls 34 and 35 of the hammer mill housing 29. The radius of curvature of the arcuate support flanges 134 is the same as the radius of curvature of the arcuate support shoulders 128 and 131 of the upper and lower track sections 124 and 125 respectively. The support shoulders 128 of the upper track sections 124 and the support flanges 134 of the screen carriers 121 are adapted to support the second screens 116 of the second screen assembly 115.

The second screen assembly 115 is secured against each of the second screen track assemblies 120 by a pair of second upper screen retainers 140 and a second lower screen retainer 141. The first upper and lower screen retainers 140 and 141 are generally arcuate with arcuate outer surfaces corresponding in curvature to the curvature of the inner surface of the second screens 116. The second upper screen retainers 140 have apertures formed therein spaced apart to correspond with apertures formed in the end walls 32 and 33 in a third or inner arcuate path. The second upper screen retainers 140 are bolted to inner surfaces of the end walls 32 and 33 in inwardly spaced relation to the support shoulders 128 of the upper track sections 124 at upper ends thereof to form an arcuate channel or slot extending therebetween which is slightly wider than the thickness of the second screens 116. The second lower screen retainers 141 have a plurality of apertures formed therein which are adapted for alignment with apertures in the end walls 32 and 33 such that the second lower screen retainers 141 may be bolted to the end walls 32 and 33. The second lower screen retainers 141 are secured to the end walls 32 and 33 in inwardly and upwardly spaced relation to the support shoulders of the lower ends of the upper track sections 124 to form an arcuate channel extending therebetween which is slightly wider than the thickness of the second screens 116. There is sufficient clearance between the upper screen retainers 140 and the support shoulders 128 of upper track sections 124 and the lower screen retainers 141 and the support shoulders 128 of the lower ends of the upper track sections 124 to permit the ends of the screens 116 to slide therebetween to facilitate insertion and removal of the screens 116. The second upper screen retainers 140 are positioned in front of upper or outer ends of the screens 116 and the second lower screen retainers 141 are positioned in front of lower or inner ends of the screens 116 to prevent the screens 116 from advancing into the path of the hammers 105.

The second screens 116 are similarly secured in place and prevented from rotating out from between the screen track assemblies 120 and retainers 140 and 141, during use, by shear bars 95 which are secured to the tub floor 14 along opposite sides of the floor opening 25. Because the swing diameter of the second hammer mill assembly 30 is smaller than that of the first hammer mill assembly 28 and the upper ends of the second screens 116 do not extend outward toward the sidewalls 34 and 35 as far as the upper ends of the first screens 66, the shear bars 95 must be mounted to move their leading edges 97 closer to the rotor axis. This is accomplished with an adapter plate 150 which may be removably mounted between each of the mounting plates 96 and the associated shear bar 95.

Each adapter plate 150 is about twice as wide as the mounting plate 96 to which it may be removably secured. A first set of apertures extend across the back half of the adapter plate 150 and are positioned in alignment with apertures in the mounting plate 96 for bolting the adapter plate 150 to the mounting plate 96. A second set of apertures extend across the front half of the adapter plate 150 and are positioned for alignment with apertures in the shear bars 95 such that the shear bars 95 may be bolted to the front half of the adapter plates 150 on upper surfaces thereof. Each adapter plate 150 includes a stop 152 welded thereto and extending lengthwise across the adapter plate 150. A rear edge of a shear bar 95 is positioned against the stop 152 to facilitate positioning of the shear bar 95 on the adapter plate 150. Gussets 154 are welded to the bottom of each adapter plate 150. The gussets 154 on adapter plates 150 extend in alignment with the gussets 98 on the mounting plates 96 when the adapter plates 150 are mounted thereto.

When the shear bars 95 are bolted to the adapter plates 150 which are in turn bolted to the mounting plates 96, the shear bars 95 generally extend in radial alignment with the rotor axis such that the path of the hammer tips 110 generally extend transverse to a leading edge 97 of the shear bars 95. The leading edges 97 of the shear bars 95 are spaced approximately an equal distance from the hammer tips 110 as the inner surface of the second screens 116, which in a preferred embodiment is approximately ½ inch. The adapter plates 150 generally move the shear bars 95 laterally closer to a vertical axis extending through the rotor axis and position the shear bars 95 such that a lower surface of each shear bar, across the front thereof, extends in closely spaced relation over an upper edge of an associated screen 116 to secure the screens 116 in place.

Replacing the first hammer mill assembly 28 with the second hammer mill assembly 30 is a relatively easy procedure. The tub 13 is first pivoted away from the frame members 10 and 11 to provide access to the hammer mill assembly 28. The tub 13 is adapted to tilt over 100° relative to the frame members 10 and 11. With the shear bars 95 advanced away from the upper ends of the screens 66, the screens 66 are slid out from between the first screen track assemblies 70 and the first upper and lower screen retainers 90 and 91.

The first screen track assemblies 70 and the first upper and lower screen retainers 90 and 91 are then removed from the end walls 32 and 33 and replaced with the second screen track assemblies 120 and the second upper and lower screen retainers 140 and 141 which are secured to the end walls 32 and 33. The first screen carriers 71 are similarly disconnected from the mounting blocks 86, removed and replaced by the second screen carriers 121 which are bolted to the mounting blocks 86.

The first hammers 55 are removed from the hammer mill rotor assembly 40 by removing the mounting pins 43 from the aligned apertures in the rotor plates 42 and the first hammer bases 56 and removing the first hammers 55 from between the rotor plates 42. The second hammers 105 are then positioned such that the apertures extending through the bases 106 thereof are aligned with the appropriate rotor apertures 54 and the mounting pins 43 are slid back through the aligned apertures and secured in place by conventional means such as a cover plate or retainer as discussed above but not shown. As can be appreciated from the drawings, generally only two mounting pins 43 can be removed at a time because only two pins 43 generally extend completely above the end walls 32 and 33 in the rotational path of the rotor assembly 40.

After the first hammers 55 are replaced by the second hammers 105, the second screens 116 are slid into place between the second screen track assemblies 120 and the second upper and lower screen retainers 140 and 141.

In completing the changeout process, the shear bars 95 are disconnected from the mounting plates 96, the adapter plates 150 are secured thereto and the shear bars 95 are secured to the adapter plates 150. Both upper edges of the shear bars 95 are formed from hardened steel such that either upper edge may be used as the leading edge 97. With the above noted changes completed, the tub 13 is pivoted back on top of the frame members 10 and 11 and is ready for use. The second hammer mill assembly 30 is similarly replaceable with the first hammer mill assembly 28.

The hammers 55 or 105 which are not in use are stored in a conventional hammer storage box (not shown) mounted to the tub grinder frame 4 and the screens 66 and 116 which are not in use are stored on conventional screen racks (not shown) mounted to the tub grinder frame 4. The screen carriers 71 and 121 which are not in use as well as the first and second screen track assemblies 70 and 120 and the first and second upper and lower screen retainers 9 and 91 and 140 and 141 which are not in use are also stored in storage boxes (not shown) secured to the tub grinder frame 4.

In use, material to be processed is placed in the tub 13. As the tub sidewall 15 rotates relative to the floor 14 material is advanced into the rotational path of the hammers 55 or 115. The shearing action of the hammers 55 or 105 against the shear bars 95 chops the material into smaller pieces which are pulled through the floor opening 25. The material is further ground between the hammers 55 or 115 and the associated screens 66 and 116 respectively. Ground material falls through the openings 67 and 117 in the screens 66 and 116 and downward through the hammer mill housing 29. Guide plates 160 are welded to the housing 29 and extend between the end walls 32 and 33. Each guide plate 160 extends from one of the sidewalls 34 and 35 and slopes downwardly and inwardly to a lower hammer mill housing opening 162.

Processed material falling through the openings 67 or 117 in the screens 66 or 116 falls through the lower hammer mill housing opening 162 or onto the guide plates 160 and then through the lower hammer mill housing opening 162 and onto a conveyor belt 165 extending therebelow. The conveyor belt 165 carries the processed material rearward and upward away from beneath the tub 13 and generally drops the processed material onto a pile.

It is to be understood that while certain forms of the present invention have been illustrated and described herein, it is not to be limited to the specific forms or arrangement of parts described and shown. For example, although the tub grinder 1 of the present invention was shown as having interchangeable hammer mill assemblies of two different swing diameters, it is foreseeable, that the tub grinder could be adapted to utilize hammer mill assemblies of three or more different sizes. It is also noted that although the shear bars 95 are shown mounted in an inward and downwardly sloping orientation, it is foreseen that the shear bars 95 could be mounted flat or horizontally relative to the floor of the tub grinder. For the purposes of this application the combination of the rotor assembly 40 with the first hammers 55 or the second hammers 105 secured thereto may also be referred to as a hammer assembly. In addition, instead of replacing one set of hammers with a longer set of hammers, it is foreseeable that the swing diameter of the a hammer mill assembly could be increased by bolting or otherwise securing extensions thereto to increase the overall length of each hammer. To decrease the swing diameter, the extensions would then be removed.

What is claimed and desired to be secured by Letters Patent is as follows:

1. A tub grinder for chopping and grinding material comprising:

a) a frame;

b) a floor secured to said frame and having a floor opening extending therethrough;

c) a tub sidewall rotatably mounted relative to said floor for rotation thereabout; said floor and said tub sidewall forming a tub into which material to be processed is placed;

d) a hammer mill housing extending below said tub floor adjacent said floor opening;

e) a rotor assembly rotatably mounted to and extending within said hammer mill housing and rotatable about a rotor axis;

f) a plurality of first hammers removably securable to said rotor assembly and having a first swing radius; at least a portion of each of said first hammers extending through said floor opening and above said floor along a portion of a path of travel of said first hammers during rotation of said rotor assembly;

g) a first semi-cylindrical screen assembly removably securable within said hammer mill housing in coaxial alignment with said rotor axis and having a first radius of curvature which is greater than the first swing radius of said first hammers; said first semi-cylindrical screen assembly securable within said hammer mill housing so as to extend in closely spaced relation to a path of rotation of a tip of each of said first hammers;

h) a plurality of second hammers removably securable to said rotor assembly in place of said first hammers and having a second swing radius which is smaller than the first swing radius; at least a portion of each of said second hammers extending through said floor opening and above said floor along a portion of a path of travel of said second hammers during rotation of said rotor assembly; and i) a second semi-cylindrical screen assembly removably securable within said hammer mill housing in place of said first screen assembly and in coaxial alignment with said rotor axis; said second screen assembly having a second radius of curvature which is greater than said second swing radius and smaller than said first radius of curvature of said first screen assembly said second semi-cylindrical screen assembly securable within said hammer mill housing so as to extend in closely spaced relation to a path of rotation of a tip of each of said second hammers.

2. The tub grinder as in claim 1 further comprising:

a) a pair of shear bars removably mountable to a pair of mounting plates on said tub floor on opposite sides of said floor opening such that inner edges of said shear bars generally extend in closely spaced relation to said path of rotation of said tips of said first hammers; and b) a pair of adapter plates removably securable to said mounting plates and adapted for securement of said shear bars thereto such that inner edges of said shear bars generally extend in closely spaced relation to said path of rotation of said tips of said second hammers when said second hammers are mounted to said rotor assembly and such that said inner edges of said shear bars are positioned closer to said rotor axis when said shear bars are mounted on said adapter plates than when mounted on said mounting plates.

3. In a tub grinder having a plurality of first hammers with a first length selected for grinding a first material, said first hammers being removably securable to a rotor assembly rotatably mounted within a hammer mill housing below a floor opening in a floor of said tub grinder and having a first semi-cylindrical screen assembly removably securable within said hammer mill housing in co-axial alignment with a rotor axis of said rotor assembly and in closely spaced relation outward from a path of rotation of a tip of each of said first hammers, the improvement comprising:

a) a plurality of second hammers removably securable to said rotor assembly in place of said first hammers, said second hammers having a second length selected for grinding a second material having different characteristics than the first material; and b) a second semi-cylindrical screen assembly having a different radius of curvature than said first semi-cylindrical screen assembly and being removably securable within said hammer mill housing in place of said first semi-cylindrical screen assembly in coaxial alignment with said rotor axis and in closely spaced relation outward from a path of rotation of a tip of each of said second hammers.

4. The improved tub grinder as in claim 3 further comprising:

a) a pair of shear bars removably mountable to a pair of mounting plates on said tub floor on opposite sides of said floor opening such that inner edges of said shear bars generally extend in closely spaced relation to said path of rotation of said tips of said first hammers; and b) a pair of adapter plates removably securable to said mounting plates and adapted for securement of said shear bars thereto such that inner edges of said shear bars generally extend in closely spaced relation to said path of rotation of said tips of said second hammers when said second hammers are mounted to said rotor assembly and such that said inner edges of said shear bars are positioned closer to said rotor axis when said shear bars are mounted on said adapter plates than when mounted on said mounting plates.

5. In a tub grinder having a hammer assembly rotatably mounted within a hammer mill housing below a floor opening in a floor of said tub grinder; said hammer assembly having a first swing diameter selected for grinding a first material; and said tub grinder having a first semi-cylindrical screen assembly removably securable within said hammer mill housing in co-axial alignment with an axis of rotation of said hammer assembly and in closely spaced relation outward from a path of rotation of a tip of said hammer assembly, the improvement comprising:

a) means for changing the swing diameter of said hammer assembly from said first swing diameter to a second swing diameter selected for grinding a second material having different characteristics than the first material; and b) means for replacing said first semi-cylindrical screen assembly with a second semi-cylindrical screen assembly having a different radius of curvature than said first semi-cylindrical screen assembly, such that said second semi-cylindrical screen assembly is removably securable within said hammer mill housing in co-axial alignment with an axis of rotation of said hammer assembly and in closely spaced relation outward from a path of rotation of a tip of said hammer assembly having said second swing diameter.

6. The improved tub grinder as in claim 5 further comprising:

a) a pair of shear bars; and b) means for mounting said shear bars to said floor of said tub grinder along opposite sides of said floor opening such that inner edges of said shear bars selectively extend in closely spaced relation outward from a path of rotation of said tip of said hammer assembly having said first swing diameter or in closely spaced relation outward from a path of rotation of said tip of said hammer assembly having said second swing diameter.

* * * * *